United States Patent [19]

Gardner

[11] 4,136,816

[45] Jan. 30, 1979

[54] SELF LOCKING CONTAINER

[75] Inventor: Jeffrey M. Gardner, Wheaton, Ill.

[73] Assignee: Container Corporation of America, Chicago, Ill.

[21] Appl. No.: 866,481

[22] Filed: Jan. 3, 1978

[51] Int. Cl.[2] ..... B65D 5/08; B65D 5/02

[52] U.S. Cl. ..... 229/33; 229/38

[58] Field of Search ..... 229/33, 36, 38, 39 R, 229/37 R

[56] References Cited

U.S. PATENT DOCUMENTS

| | | | |
|---|---|---|---|
| 1,147,652 | 7/1915 | Scudder | 229/37 R |
| 1,167,869 | 5/1928 | Peterson | 229/33 X |
| 2,492,712 | 12/1949 | Ringler | 229/39 R |
| 2,523,246 | 9/1950 | Elliott et al. | 229/38 |
| 3,016,181 | 1/1962 | Desmond | 229/39 R |
| 3,112,853 | 12/1963 | Welshenbach | 229/33 |
| 3,454,209 | 7/1969 | Persson | 229/33 |
| 3,724,741 | 4/1973 | Jacobson | 229/38 |
| 3,853,260 | 12/1974 | Wood | 229/39 R X |

*Primary Examiner*—Davis T. Moorhead

*Attorney, Agent, or Firm*—Carpenter & Ostis

[57] ABSTRACT

A self-locking container formed of a unitary blank of foldable paperboard having integral cover and reclosing means.

2 Claims, 4 Drawing Figures

SELF LOCKING CONTAINER

SUMMARY OF THE INVENTION

This invention relates to paperboard containers and more particularly to a one-piece, self-locking, bellows type folder having top and bottom sections foldably joined to each other by a common rear wall.

It is an object of the invention to provide, in a container of the type described, means of affording an interlocking connection between the cover and front wall to eliminate the need for outside securing means.

A more specific object of the invention is to provide a container having a pair of hinged sections wherein one wall of the container presents a pocket for receiving a closure flap projecting from an adjacent wall.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
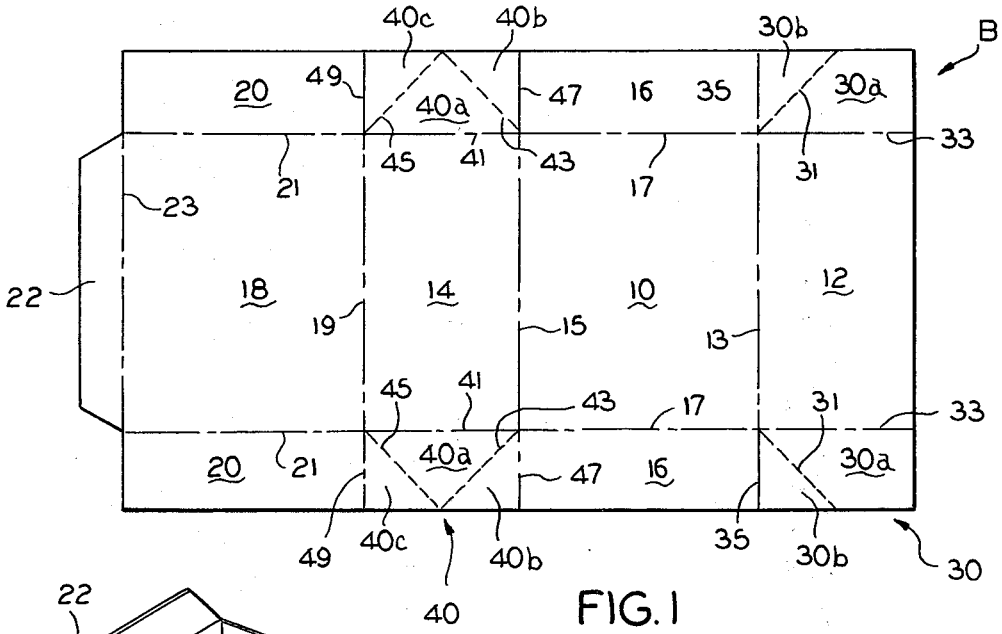
FIG. 1 is a plan view of a blank of foldable material from which the container illustrated in the other views may be formed.
Figure 4:
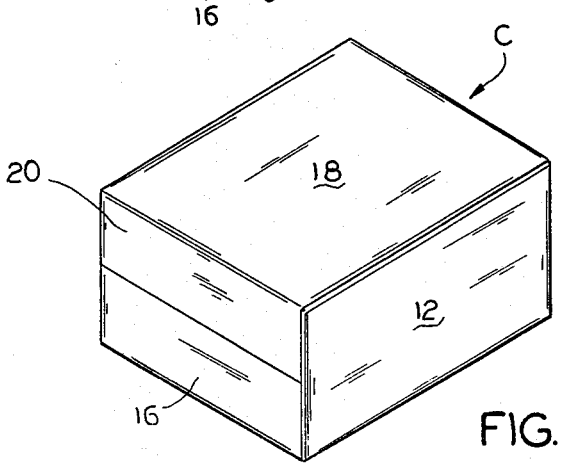
FIG. 4 is a perspective view of a container embodying features of the invention as shown in the erected and closed condition.

Referring now to the drawings for a better understanding of the invention, it will be seen that a self-locking container indicted generally at C in FIG. 4 may be formed from a unitary blank B of foldable sheet material such as paperboard illustrated in FIG. 1.

Figure 2:
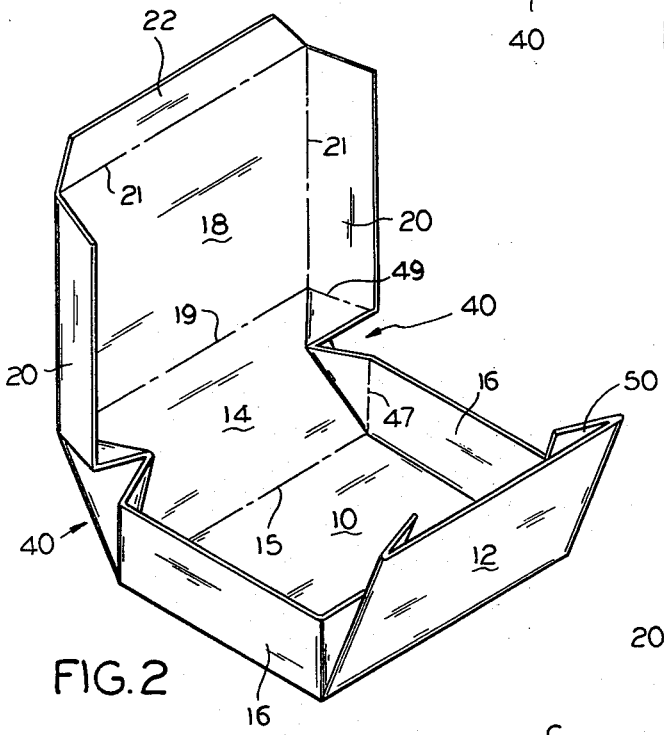
FIGS. 2 and 3 are perspective views illustrating the manner in which the container illustrated in FIG. 4 may be formed, erected, and closed.

As best seen in FIGS. 1 and 2, container C includes a bottom wall 10 having a pair of front and rear walls 12 and 14 foldably joined to the front and rear edges thereof on fold lines 13 and 15, respectively. A pair of lower side wall panels 16 are foldably joined to opposed side edges of bottom wall 10 along fold lines 17.

Figure 3:
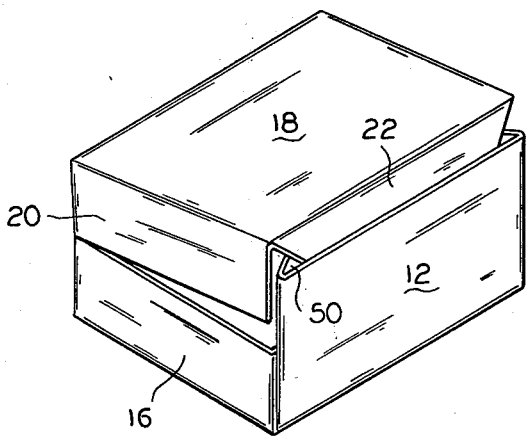

A top wall 18 is foldably joined at its rear edge along fold line 19 to the upper edge of rear wall 14. Top wal 19 has a pair of upper side panels 20 foldably joined to its opposed side edges along fold lines 21. As best seen in FIGS. 2 and 3, upper and lower side wall panels 20 and 16, respectively, each extend half way between the top and bottom of the container to provide common side walls of single ply thickness. A tuck flap 22 is foldably joined at its upper edge on fold line 23 to the forward edge of top wall 18.

The lower side wall panels 16 of the container are foldably joined to the front wall 12 by a pair of bellows members indicated generally at 30. Each of the bellows members 30 includes a pair of first and second gusset elements **30*a* and 30*b*, respectively, which are foldably joined to each other along a fold line 31 which extends diagonally upward from the related front corner of bottom wall 10. Gusset elements 30*a* and 30*b* are also foldably joined to related edges of front wall 12 and lower side wall panels 16 on fold lines 33 and 35**, respectively.

At the rear of the container another pair of bellows members 40 serve to connect both of the upper and lower side wall panels of the container to rear wall 14 and to each other. Each of the bellows members 40 includes three preferably triangular gusset element **40*a*, 40*b*, and 40*c*. Center gusset element 40*a* is foldaly joined along one side edge on fold line 41 to rear wall 14 and is foldably joined on its other two side edges to second and third gusset elements 40*b* and 40*c* along fold lines 43 and 45, respectively. Side gusset elements 40*b* and 40*c* are foldably joined along fold lines 47 and 49 to rear edges of lower and upper side wall panels 16 and 20**, respectively.

When the carton is erected as shown in FIGS. 2 and 3, it will be noted that the first gusset elements **30*a* which are folded behind or inside of front wall 12, form therewith an opening or pocket 50 which is adapted to receive the closure flap 22, as shown in FIGS. 3 and 4**, to provide a means of interlocking connection between the top and front walls of the container which is entirely self contained and does not require any outside securing means.

I claim:

1. A self-locking container, formed of a unitary blank of foldable paperboard, comprising:

(a) a pair of top and bottom walls interconnected by a rear wall foldably joined at its upper and lower edges to rear edges of said top and bottom walls;

(b) a front wall foldably joined at its lower edge to a front edge of said bottom wall;

(c) opposed pairs of upper and lower side wall panels foldably joined to opposed side edges of said top and bottom walls;

(d) opposed pairs of front and rear bellows members foldably joining said side wall panels to said front and rear walls;

(e) said rear bellows members also foldably joining said upper side wall panels to said lower side wall panels at the rear of said container;

(f) a closure flap foldably joined to and depending from a front edge of said top wall;

(g) said front bellows members forming with said front wall a pocket for receiving said closure flap to provide interlocking means for closing said container.

2. A self-locking container, formed of a unitary blank of foldable paperboard, comprising:

(a) a pair of top and bottom walls interconnected by a rear wall foldably joined at its upper and lower edges to rear edges of said top and bottom walls;

(b) a front wall foldably joined at its lower edge to a front edge of said bottom wall;

(c) opposed pairs of upper and lower side walls panels foldably joined to opposed side edges of said top and bottom walls;

(d) a closure flap foldably joined to and depending from a front edge of said top wall;

(e) said front wall presenting a pocket for receiving said closure flap to provide interlocking means for closing said container.

* * * * *